United States Patent [19]

Ewing

[11] Patent Number: 4,791,539

[45] Date of Patent: Dec. 13, 1988

[54] LUMINAIRE HAVING QUICK-DISCONNECT ELECTRICAL COMPONENTS

[75] Inventor: Robert L. Ewing, Newark, Ohio

[73] Assignee: Manville Corporation, Denver, Colo.

[21] Appl. No.: 533,325

[22] Filed: Sep. 16, 1983

[51] Int. Cl.[4] ..... F21S 13/10; F21V 23/02; H01R 33/00

[52] U.S. Cl. ..... 362/226; 362/310; 362/362; 362/374; 362/431

[58] Field of Search ..... 362/95, 147, 221, 222, 362/226, 277, 282, 285, 287, 296, 307, 310, 311, 362, 364, 365, 368, 370, 374, 375, 410, 411, 414, 431, 432; 248/220.2, 222.2; 312/245; 403/207, 346, 347; 174/52 R, 66; 361/369–371, 417, 419, 420, 427–429, 340, 391; 220/334, 377; 16/231, 269, 366

[56] References Cited

U.S. PATENT DOCUMENTS

| | | | |
|---|---|---|---|
| 2,270,814 | 1/1942 | Scribner | 362/221 |
| 2,918,995 | 12/1959 | Kruger | 403/346 X |
| 3,071,683 | 1/1963 | Queale | 362/368 X |
| 3,353,015 | 11/1967 | Franklin et al. | 362/374 X |
| 3,541,395 | 11/1970 | Lucchino | 361/391 X |
| 3,761,781 | 9/1973 | Dean | 362/374 X |
| 3,928,758 | 12/1975 | Osteen et al. | 362/362 |
| 4,019,044 | 4/1977 | Kelley et al. | 362/362 X |
| 4,156,902 | 5/1979 | Wandler | 362/362 X |
| 4,220,986 | 9/1980 | Matteo et al. | 362/362 |
| 4,268,897 | 5/1981 | Schierwagon et al. | 362/226 X |
| 4,323,953 | 4/1982 | Hutchison | 362/226 |
| 4,345,304 | 8/1982 | Penney et al. | 362/226 X |
| 4,374,407 | 2/1983 | Drost et al. | 362/432 |
| 4,429,354 | 1/1984 | Garnett | 362/362 X |

FOREIGN PATENT DOCUMENTS

| | | | |
|---|---|---|---|
| 500247 | 3/1954 | Canada | 362/221 |

*Primary Examiner*—David H. Brown

*Attorney, Agent, or Firm*—John D. Lister; Cornelius P. Quinn

[57] ABSTRACT

A new and improved mounting arrangement for electrical components in a luminaire in which the electrical components are mounted on an electrical plate which is detachably secured to a support plate with quick disconnect means being provided for detaching said electrical plate from said support plate.

1 Claim, 3 Drawing Sheets

FIG. 1
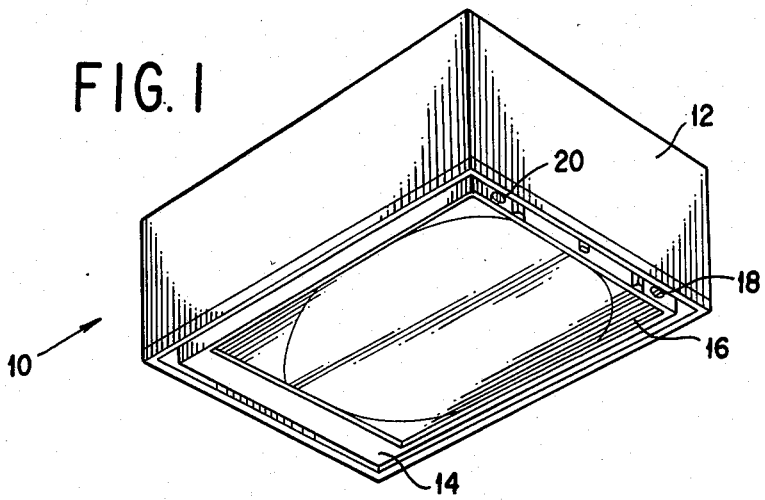
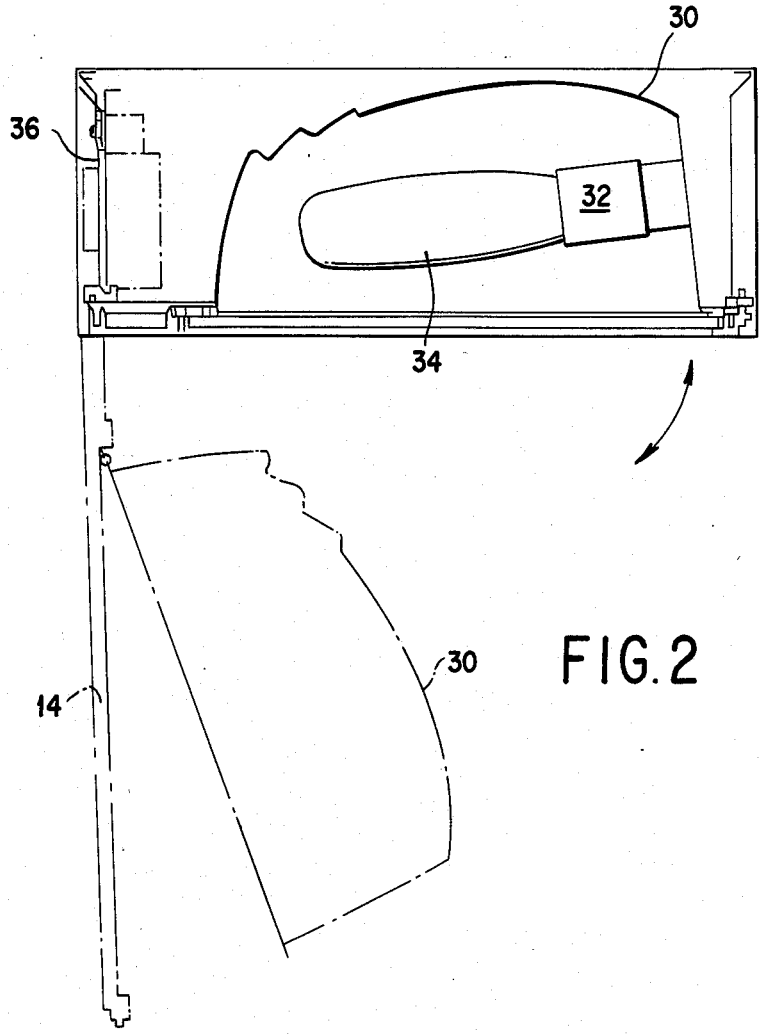
FIG. 2

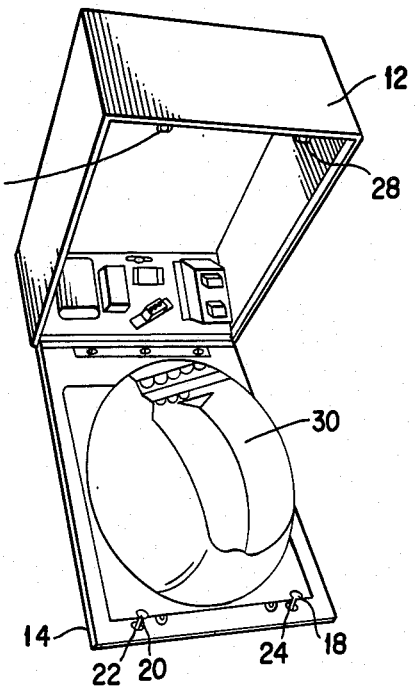
FIG. 3
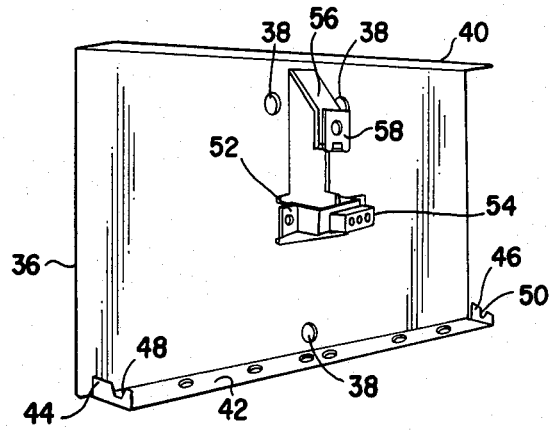
FIG. 4
FIG. 5
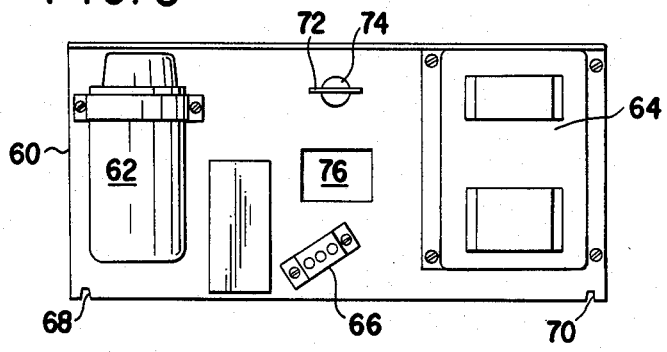

LUMINAIRE HAVING QUICK-DISCONNECT ELECTRICAL COMPONENTS

This invention relates to an improved low-profile pole mounted luminaire providing not only compactness and a low profile contemporary architectural style, but ease of maintenance as well.

As can be readily appreciated, while pole mounted luminaires do not require a significant amount of maintenance, occasionally an electrical component does need to be repaired or replaced and such maintenance is provided on site, up on the pole where the luminaire is mounted.

It is an object of this invention to minimize the maintenance time required up on the pole in servicing luminaires.

It is an object of the present invention to enable any such maintenance to be achieved in an efficient and expeditious manner by providing a luminaire in which the assembly of electrical components is readily removable and replaceable.

Another object of this invention is to provide a luminaire free from obsolence resulting from new-generation electrical components, as a new electrical component assembly will be able to be easily and readily substituted.

SUMMARY OF THE INVENTION

The present invention is directed to a new and improved mounting arrangement for electrical components in a luminaire in which all of the electrical components are mounted on an electrical plate which is detachably secured to a support plate with quick disconnect means being provided for detaching said electrical plate from said support plate, whereby said electrical plate and said electrical components are easily removed from the luminaire for servicing or replacement.

BRIEF DESCRIPTION OF THE DRAWINGS

FIG. 1 is a perspective view of an improved luminaire embodying the present invention.

FIG. 2 is a side elevation view, partially broken away and illustrating the access to the lamp and electrical assembly of the luminaire shown in FIG. 1.

FIG. 3 is a perspective view of the luminaire shown in FIGS. 1 and 2 with an access door in an open position.

FIG. 4 is a perspective view of a support plate embodied in the luminaire shown in FIGS. 1, 2 and 3.

FIG. 5 is a front elevational view of an electrical plate for supporting electrical components embodied in the luminaire shown in FIGS. 1, 2 and 3.

.

DETAILED DESCRIPTION OF THE PREFERRED EMBODIMENT

Figure 6:
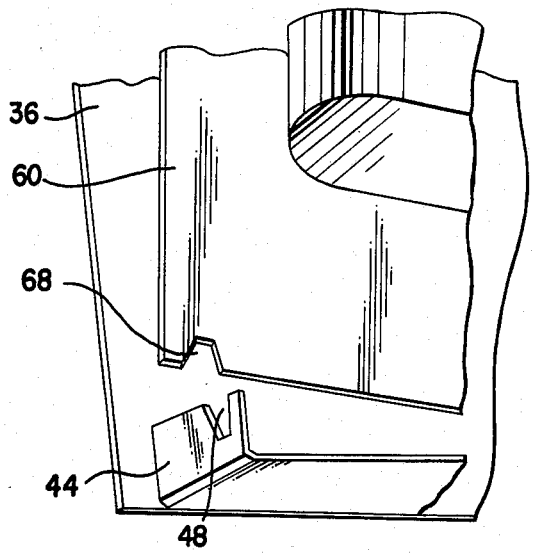
FIG. 6 is a partial perspective view of the support plate shown in FIG. 4 and the electrical plate shown in FIG. 5 illustrating the notching details on both the support plate and electrical plate for engaging the plates together.
Figure 7:
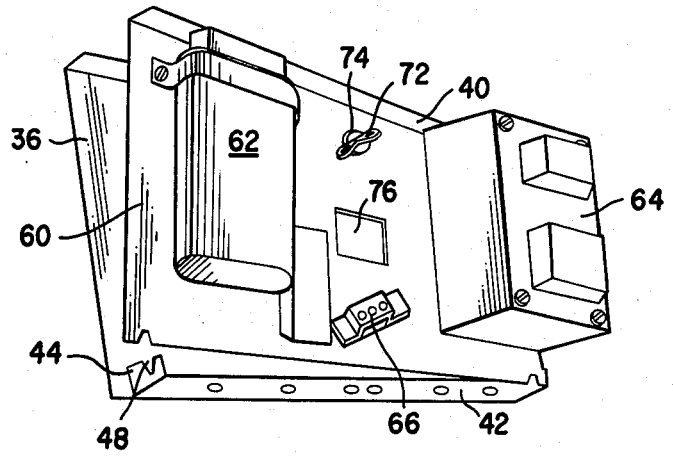
FIG. 7 is a perspective view of the support plate and electrical plate shown in FIG. 4 and FIG. 5 being placed in an engaging relationship.

Referring now to the Drawings, there is shown in FIG. 1 a low-profile rectilinear shaped luminare generally identified by the reference numeral 10 for mounting on building facades or poles.

The luminaire 10 has a die-formed aluminum housing 12 with tight welded seams. A cast aluminum door frame enclosure 14 is pivotedly mounted on the housing 12 and is fitted with a rugged borosilicate glass lens 16 gasketed to keep out moisture, dirt and bugs. A pair of standard quarter turn fasteners 18 and 20 project through a pair of holes 22 and 24 formed in the door frame enclosure 14 for locking engagement with a pair of clip on receptacles 26 and 28 mounted on the housing 12, thereby providing a means to lock the door 14 in a closed position as shown in FIG. 1, and FIG. 2 and open it to gain access to the interior of the housing 12 as illustrated by the dashed lines depicting the door frame 14 in FIG. 2 and as shown in FIG. 3 in the open position.

As shown in FIGS. 3 and 2, a precisely contoured hydroformed, anodized aluminum reflector 30 is pivotedly mounted on the door frame 14. Mounted within the reflector 30 is a socket 32 and a lamp 34. As illustrated in FIG. 2, with the door frame 14 in an open position, the lamp 34 may be quickly replaced by merely pivoting the reflector 30 upward, removing the lamp 34 from the socket 32 and inserting a new lamp 34 in it's place.

As illustrated in FIG. 2, a support plate 36 preferably of one piece construction and formed from sheet steel, is attached to the housing 12. As shown in FIG. 4, a number of mounting holes 38 are provided for receiving mounting screws (not shown) for attaching the support plate 36 to the housing 12. As illustrated in FIG. 4, an upper and lower portion of the support plate 36 is bent along a straight longitudinal line forward approximately 90° forming an upper longitudinal ledge 40 and a lower longitudinal ledge 42. The left hand and right hand corners of the ledge 42 are cut and turned upward 90° forming tabs 44 and 46 respectively. A pair of notches 48 and 50 are provided in the tabs 44 and 46 respectively. An opening with a pair of tabs 52 (one not shown) is provided in the support plate 36 for mounting an electrical connector 54. A tab 56 is also bent outward from the support plate 36 to support a clip-on receptacle 58.

As shown in FIG. 5, an electrical plate 60 has mounted thereon a capacitor 62, a ballast 64 and an electrical connector 66. In addition to these components, any other electrical components or circuitry required may be so mounted.

Two notches 68 and 70 are formed to the left and right handed corners respectively of the electrical plate 60 to engage notches 48 and 50 in the support plate 36. A quarter turn fastener 72 mounted in a hole 74 formed in the electrical plate 60 is aligned to be received by the clip-on receptacle 58 for locking the electrical plate 60 in place on the support plate 36. An opening 76 is also formed in the electrical plate 60 for providing access to the electrical connector 54.

The wiring (not shown) for the electrical components such as the capacitor 62, the ballast 64 and the electrical connector 66 are plugged into the electrical connector 54 which in turn is connected to a power source. A wire and plug disconnect (not shown) connected to the lamp socket 32 is received in the electrical conector 66.

In operation access to the interior of the housing 12 to service or replace the electrical components of the luminaire 10 is achieved by first turning the quarter turn fasteners 18 and 20 swinging the door frame 14 downwardly, disconnecting the electrical connectors 54 and 66, turning the quarter turn fastener 72 to release the electrical plate 60 and lifting the electrical plate 60 with all of it's electrical components out of the luminaire to the ground for more convenient servicing or to be replaced with another or an updated electrical plate with the electrical components mounted thereon.

While the invention has been particularly shown and described in reference to a preferred embodiment thereof, it will be understood by those skilled in the art that various changes in form and details may be made therein without departing from the spirit and scope of the invention.

What is claimed is:

1. In a luminaire having a housing, a lamp socket, a lamp, a reflector and electrical components, the improvement comprising, a support plate fixed to the housing, an electrical plate detachably secured to said support plate, said electrical components being mounted on said electrical plate and removable with said electrical plate and quick-disconnect means comprising a single quarter turn fastener for fastening and detaching said electrical plate from said support plate, said support plate having notches formed therein and said electrical plate having notches formed therein for engaging the notches in said support plate and thereby aligning said electrical plate relative to said support plate

* * * * *